US011784413B2

(12) United States Patent
Bray

(10) Patent No.: US 11,784,413 B2
(45) Date of Patent: Oct. 10, 2023

(54) WIDEBAND RADIAL LINE SLOT ARRAY ANTENNA

(71) Applicant: The Johns Hopkins University, Baltimore, MD (US)

(72) Inventor: Matthew G. Bray, Ellicott City, MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 17/705,554

(22) Filed: Mar. 28, 2022

(65) Prior Publication Data

US 2022/0399649 A1 Dec. 15, 2022

Related U.S. Application Data

(60) Provisional application No. 63/209,972, filed on Jun. 12, 2021.

(51) Int. Cl.
*H01Q 9/04* (2006.01)
*H01Q 19/15* (2006.01)
(Continued)

(52) U.S. Cl.
CPC ..... *H01Q 9/0421* (2013.01); *H01Q 1/40* (2013.01); *H01Q 19/13* (2013.01); *H01Q 19/15* (2013.01); *H01Q 21/0012* (2013.01)

(58) Field of Classification Search
CPC .... H01Q 2/0012; H01Q 9/0421; H01Q 19/13; H01Q 19/15
See application file for complete search history.

(56) References Cited

U.S. PATENT DOCUMENTS 3,032,762 A * 5/1962 Kerr ..... H01Q 21/20 343/771
3,348,227 A * 10/1967 Rolfs ..... H01Q 25/001 343/768

(Continued)

FOREIGN PATENT DOCUMENTS

JP H05110335 A * 4/1993 ..... H01Q 21/24
TW 202027334 A * 7/2020 ..... H01Q 1/085

OTHER PUBLICATIONS

Matthew Bray, "A Radial Line Slot Array Antenna for Deep Space Missions," 2017 IEEE Aerospace Conference/IEEE Xplore, Mar. 2017, pp. 1-6.

(Continued)

*Primary Examiner* — Dimary S Lopez Cruz
*Assistant Examiner* — Jordan E. DeWitt
(74) *Attorney, Agent, or Firm* — Noah J. Hayward

(57) ABSTRACT

An antenna includes a waveguide defined by a gap between a backplane with radial support ribs and a facesheet, a teardrop-shaped feed pin at a center of the backplane, and a foam spacer between the backplane and facesheet. An outward facing side of the facesheet includes thermal paint. The facesheet includes pairs of through-hole slots for releasing portions of a wave of radiation in the waveguide to generate a transmit-beam or to receive the receive-beam to generate the wave of radiation. The pairs may be disposed as a spiral array about a center of the facesheet. Each of the pairs may include first and second slots. A length of the second slot is oriented approximately perpendicular to a length of the first slot. Dispositions of the slots are set by a computer process. The dispositions optimize a trade-off between transmit and receive gains.

10 Claims, 8 Drawing Sheets

(51) Int. Cl.

| | |
|---|---|
| ***H01Q 19/13*** | (2006.01) |
| ***H01Q 1/40*** | (2006.01) |
| ***H01Q 21/00*** | (2006.01) |

(56) References Cited

U.S. PATENT DOCUMENTS

| | | | | |
|---|---|---|---|---|
| 3,521,290 | A * | 7/1970 | Hossein | B64G 1/22 343/915 |
| 4,973,972 | A * | 11/1990 | Huang | H01Q 1/523 333/26 |
| 2006/0061510 | A1* | 3/2006 | Itsuji | H01Q 9/28 343/786 |
| 2014/0354498 | A1* | 12/2014 | Balma | H01Q 13/18 343/771 |
| 2016/0352022 | A1* | 12/2016 | Thomson | H01Q 1/288 |
| 2017/0256865 | A1* | 9/2017 | Sikes | H01Q 1/48 |
| 2018/0076521 | A1* | 3/2018 | Mehdipour | H01Q 15/0026 |
| 2020/0044326 | A1* | 2/2020 | Olfert | H01Q 1/40 |
| 2021/0258069 | A1* | 8/2021 | Sazegar | H01Q 21/0025 |
| 2022/0328965 | A1* | 10/2022 | Chalabi | H01Q 25/002 |
| 2022/0399649 | A1* | 12/2022 | Bray | H01Q 19/15 |

OTHER PUBLICATIONS

F. J. Goebels, Jr. et al., "Arbitrary Polarization from Annular Slot Planar Antennas," IRE Transactions on Antennas and Propagation, Jul. 1961, pp. 342-349.

A. Akiyama et al., "Numerical optimisation of slot parameters for a concentric array radial line slot antenna," IEE Proc.- Microw. Antennas Propag., vol. 145, No. 2, Apr. 1998, pp. 141-145.

Makoto Ando et al., "A Radial Line Slot Antenna for 12 GHz Satellite TV Reception," IEEE Transactions no Antennas and Propagation, vol. AP-33, KO. 12, Dec. 1985, pp. 1347-1353.

William A. Imbriale et al., "Spacebome Antennas for Planetary Exploration," Chapter 5 ("The Orbiters"), Deep Space Communications and Navigation Series, California Institute of Technology Jet Propulsion Laboratory, Jan. 2006, pp. 213-303.

Robert E. Wallis et al., "Testing of the Messenger Spacecraft Phased-Array Antenna," IEEE Antennas and Propagation Magazine, vol. 47, No. 1, Feb. 2005, pp. 204-209.

Unknown Author(s), "Double Asteroid Redirection Test (DART) Mission," NASA, May 2019, available online at https://www.nasa gov/planetarydefense/dart (last accessed Dec. 21, 2021); pp. 1-6.

Heike Trautmann et al., "R2-EMOA: Focused Multiobjective Search Using R2-Indicator-Based Selection," Learning and Intelligent Optimization Conference (LION 7), Jan. 2013, Catania, Italy, pp. 1-6.

Paul I. Kolesnikoff II, "Antenna Gain Measurement Errors Due to Finite Source Axial Ratio," Antenna Measurement Techniques Association (AMTA) Symposium, Nov. 2000, pp. 181-186.

Matthew Bray, "A Spiral Radial Line Slot Array Antenna with Metallic Standoffs for Deep Space Missions," IEEE Xplore, 978-1-5386-3284-0/17, 2017, pp. 621-622.

Hideki Ueda et al., "Space-Use Radial Line Slot Antenna in 8GHz Band with Honeycomb Structure," IEEE Xplore, 978-1-4244-2042-1/08, 2008, pp. 1-4.

* cited by examiner

WIDEBAND RADIAL LINE SLOT ARRAY ANTENNA

CROSS REFERENCE TO RELATED APPLICATION

This application claims priority to and the benefit to prior-filed, co-pending U.S. Provisional Patent Application No. 63/209,972, filed Jun. 12, 2021, the entire content of which is hereby incorporated by reference herein.

STATEMENT OF GOVERNMENTAL INTEREST

This invention was made with Government support under contract number NNN06AA01C awarded by the National Aeronautics and Space Administration (NASA). The Government has certain rights in the invention.

BACKGROUND

The present disclosure relates generally to transmitter and receiver antennas and, more particularly, to radial slotted antennas for use in space satellite implementations, for example.

High-gain antennas (HGA) have been used for deep space missions such as HGAs utilized as a parabolic reflector. These antennas perform well in a variety of complex environments and generally have total efficiencies around 50-60 percent (%) in practice. Some parabolic dish antennas have issues with their form factor. For example, for a given aperture, a total height of the antenna can be tens (or more) of wavelengths tall. Also, some array-based HGAs have complicated feed networks that reduce efficiency, and may use materials that can be challenging to implement in varying thermal and high-radiation environments. Finally, space-based telecommunications links typically have much higher downlink gain than uplink gain requirement and the gap between uplink and downlink frequencies define a bandwidth that makes it difficult to design an antenna capable of operating at the uplink and downlink frequencies while meeting the uplink and downlink gain standards.

Accordingly, there is a strong need and desire for improved antenna design and fabrication to overcome the above-noted problems. Disclosed herein are embodiments directed to a radial line slot antenna and design processes that allow the antenna to operate over a wide bandwidth while maximizing uplink and downlink gains.

SUMMARY

In some non-limiting, example embodiments (hereinafter, simply "embodiments"), an antenna includes a radial waveguide configured to transmit a transmit-beam of radiation and receive a receive-beam of radiation. The waveguide may include a backplane, a feed pin, a foam spacer, and a facesheet. The backplane may include radial support ribs or other mechanical stiffening structures. The feed pin may include a teardrop shape and may be disposed at a center of the backplane. The feed pin may be configured to interact with a wave of radiation. The foam spacer may be disposed on the backplane.

In some embodiments, an effective refractive index of the waveguide with the foam spacer may be greater than approximately 1.0 and less than approximately 1.5.

In some embodiments, the facesheet may be disposed on the foam spacer and opposite to the backplane to allow the wave of radiation to propagate between the backplane and the facesheet and through the foam spacer. The facesheet may include thermal paint and pairs of through-hole slots. The thermal paint may be disposed on an outward-facing side of the facesheet.

In some embodiments, the pairs of through-hole slots may be configured to release portions of the wave of radiation to generate the transmit-beam or to receive the receive-beam to generate the wave of radiation. The pairs of through-hole slots are disposed as a spiral array about a center of the facesheet. Each of the pairs of through-hole slots may include a first slot having a length and a width and a second slot having a length and a width. The length of the second slot is oriented approximately perpendicular to a length of the first slot.

In some embodiments, dispositions of the pairs of through-hole slots may be set by a computer process using spline interpolation of parameters of the antenna and are configured to optimize or maximize trade-off between transmit and receive gains associated with the transmit-beam and receive-beam.

In some embodiments, a method of fabricating an antenna may include disposing a foam spacer on a backplane of the antenna. The backplane may include radial support ribs. The method may further include inserting a feed pin of the antenna at a center of the backplane, the feed pin including a teardrop shape. The method may further include disposing a facesheet of the antenna on the foam spacer and opposite the backplane. The facesheet may include pairs of through-hole slots designed using a computer-implemented process.

In some embodiments, the designing of the pairs of through-hole slots may include determining a Pareto front of transmit and receive gains of the antenna using an evolutionary multi-objective process. The Pareto front may be based on at least the pairs of through-hole slots being used for transmitting a transmit-beam of radiation and for receiving a receive-beam of radiation, the pairs being disposed as a spiral array about a center of the facesheet, each of the pairs including a first slot having a length and a width and a second slot having a length and a width, and the length of the second slot being oriented approximately perpendicular to the length of the first slot.

In some embodiments, the determining of the Pareto front may include determining physical parameters of the antenna.

In some embodiments, the determining of the physical parameters may include defining lengths of the backplane and the facesheet. The determining of the physical parameters may further include defining spacings between slots. The determining of the physical parameters may further include defining a length for an innermost one of the pairs. The determining of the physical parameters may further include defining a length for an intermediate one of the pairs. The determining of the physical parameters may further include defining a length for an outermost one of the pairs. The determining of the physical parameters may further include interpolating using a spline and the lengths of the inner most, intermediate, and outermost ones of the pairs to determine lengths of other ones of the pairs.

In some embodiments, the determining of the Pareto front may further include adjusting one or more of the physical parameters of the antenna. The determining of the Pareto front may further include determining the transmit and receive gains based on the adjusting.

Further features of the present disclosure, as well as the structure and operation of various embodiments, are described in detail below with reference to the accompanying drawings. It is noted that the present disclosure is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

The accompanying drawings, which are incorporated herein and form part of the specification, illustrate the present disclosure and, together with the description, further serve to explain the principles of the present disclosure and to enable a person skilled in the relevant art(s) to make and use embodiments described herein.

Figure 1:
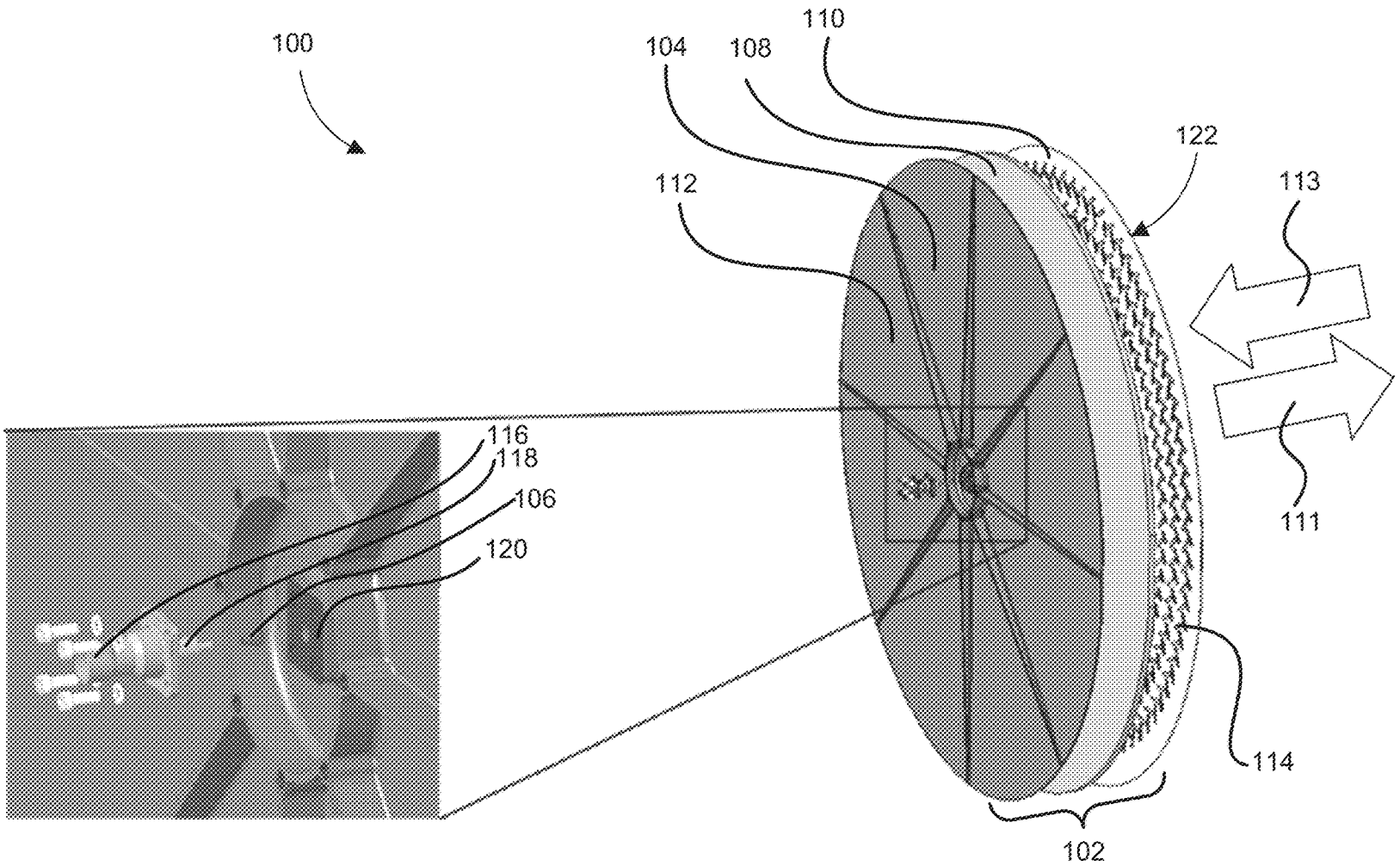
FIG. 1 shows an antenna, according to some embodiments.

The features of the present disclosure will become more readily apparent from the detailed description set forth below when taken in conjunction with the drawings, in which like reference characters identify corresponding elements throughout. In the drawings, like reference numbers generally indicate identical, functionally similar, and/or structurally similar elements. Additionally, generally, the left-most digit(s) of a reference number identifies the drawing in which the reference number first appears. Unless otherwise indicated, the drawings provided throughout the disclosure should not be interpreted as to-scale drawings.

DETAILED DESCRIPTION

This specification discloses one or more embodiments that incorporate the features of the present disclosure. The disclosed embodiment(s) are provided as examples. The scope of the present disclosure is not limited to the disclosed embodiment(s). Claimed features are defined by the claims appended hereto.

The embodiment(s) described, and references in the specification to "one embodiment," "an embodiment," "an example embodiment," etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

Spatially relative terms, such as "beneath," "below," "lower," "above," "on," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The terms "about", "approximately", or the like as used herein indicates the value of a given quantity that may vary based on a particular technology. Based on the particular technology, the terms "about", "approximately", or the like, may indicate a value of a given quantity that varies within, for example, 10-30% of the value (e.g., ±10%, ±20%, or ±30% of the value).

In some embodiments, for some space-constrained missions, a low profile HGA is desired. While the parabolic reflector is the standard for deep space high-gain antennas, several low-profile HGAs using arrays have been flown. The NASA Mars Pathfinder and Deep Impact missions used a microstrip patch array, and the Messenger spacecraft used a circularly polarized waveguide phased array. As noted, these array-based HGAs have complicated feed networks that reduce efficiency and may use materials that can be challenging to implement in varying thermal and high-radiation environments. As a technology demonstration, the Double Asteroid Redirection Test (DART) mission worked to develop a new type of Radial Line Slot Array (RLSA) operating at X-band DSN frequencies.

Embodiments of the disclosure may be implemented in hardware, firmware, software, or any combination thereof. Embodiments of the disclosure may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, and/or instructions may be described herein as performing certain actions. However, it should be appreciated that such descriptions are merely for convenience and that such actions in fact result from computing devices, processors, controllers, or other devices executing the firmware, software, routines, instructions, etc.

FIG. 1 shows an exploded view of an antenna 100, according to some embodiments. In some embodiments, antenna 100 may include a waveguide 102. Waveguide 102 may include a backplane (e.g., a backplate) 104, a feed pin 106, a spacer 108 (e.g., a foam spacer), and a facesheet 110. Backplane 104 may include support ribs 112 (e.g., radial support ribs). Facesheet 110 may include thermal paint (e.g., on an outward-facing side 122 of facesheet 110) and pairs of through-hole slots 114. The thermal paint may be particularly useful dissipating heat when antenna 100 is deployed in space.

In some embodiments, feed pin 106 may include a teardrop shape and may be disposed at a center of backplane 104. Feed pin 106 may include beryllium copper (BeCu) and/or gold plating. Spacer 108 may be disposed on backplane 104. Facesheet 110 may be disposed on spacer 108 and opposite to backplane 104. That is, spacer 108 may be disposed between backplane 104 and facesheet 110. Backplane 104 and/or facesheet 110 may include electrically conductive material. The electrically conductive material may be rigid, structurally stable, and light-weight for orbital launch and spaceflight deployment (e.g., aluminum, titanium, or the like). The electrically conductive material may also be resistant to cosmic rays for long-term space missions. The electrically conductive material may also be chosen or dropped from consideration based on performance (e.g., titanium may be lossy at radiofrequencies).

In some embodiments, antenna 100 may further include fasteners 116, a connector 118, and a shim 120. Shim 120 may be used as an aligner for connector 118 and fasteners 116. Shim 120 may be disposed between connector 118 and backplane 104. Shim 120 may include a hole to allow feed pin 106 to be inserted through backplane 104. Fasteners 116 (e.g., bolts) may structurally secure the connection assembly. Connector 118 may be a coaxial connector (e.g., BNC, TNC, SMA, or the like) coupled to feed pin 106. Shim 120 may be a single shim of a given thickness or a stack of shims having an aggregated thickness. The thickness of shim 120, as well as its material, may contribute to return loss and is chosen based on simulation and experimental data. An example of a shim with an acceptable return loss is a shim with a thickness greater than approximately 0.020 inches and less than approximately 0.28 inches (e.g., 0.024 inches). Shim 120 may include BeCu.

In some embodiments, waveguide 102 may transmit a transmit-beam 111 of radiation and/or receive a receive-beam 113 of radiation. Feed pin 106 may interact with a wave 324 of radiation (FIG. 3) (e.g., transmit the wave and/or receive the wave). Portions of the wave of radiation may be leaked from antenna 100 to form transmit-beam 111. Or, portions of receive-beam 113 may be injected into antenna 100 to form the wave of radiation. The wave of radiation may propagate in waveguide 102—that is, between backplane 104 and facesheet 110. In other words, the wave of radiation may propagate through spacer 108, which is disposed between backplane 104 and facesheet 110.

In some embodiments, spacer 108 may include material that is conducive for wave propagation (e.g., including a dielectric with a given permittivity). Transmit-beam 111 and/or receive-beam 113 may have different frequencies that define a wide bandwidth greater than approximately 0.1 GHz and less than approximately 100 GHz, greater than approximately 5 GHz and less than approximately 10 GHz, greater than approximately 7 GHz and less than approximately 9 GHz, or the like. For example, transmit-beam 111 may have a frequency of 8.4 GHz and receive-beam 113 may have a frequency of 7.2 GHz. That is, a single antenna 100 may be used for two-way communication, as opposed to using different narrowband antennas with dedicated to transmitting and the other dedicated to receiving.

Figure 2:
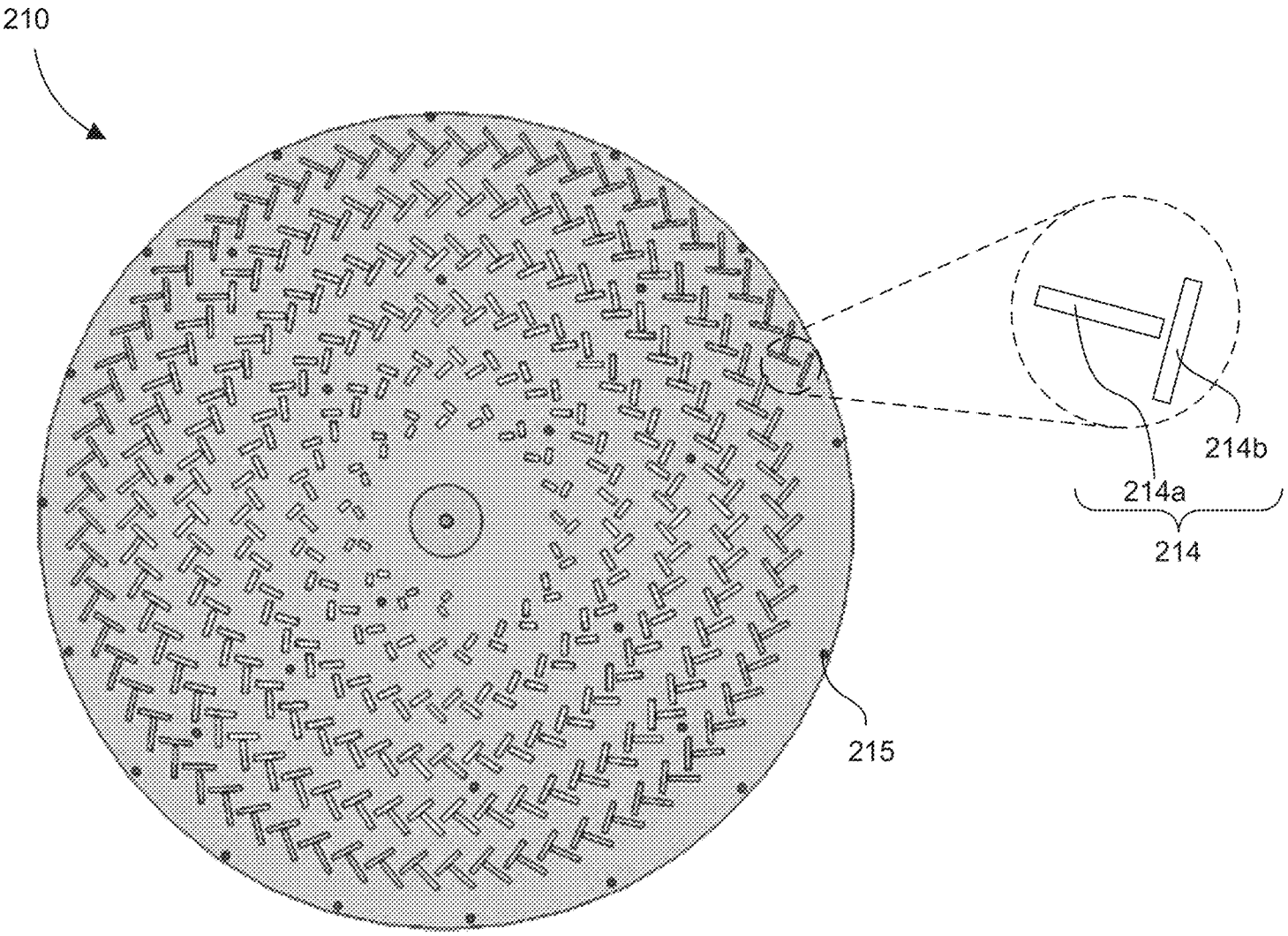
FIG. 2 shows a facesheet of an antenna, according to some embodiments.

FIG. 2 shows a facesheet 210 of an antenna, according to some embodiments. In some embodiments, facesheet 210 may represent another view of facesheet 110 (FIG. 1) to show additional details. Facesheet 210 may be identical or similar facesheet 110 (FIG. 1). Unless otherwise noted, structures and functions described previously for elements of FIG. 1 may also apply to similarly numbered elements of FIG. 2 (e.g., reference numbers sharing the two right-most numeric digits) and the structures and functions of such elements should be apparent from descriptions of corresponding elements of FIG. 1.

In some embodiments, pairs of through-hole slots 214 may include a slot 214*a* (e.g., a "first slot") and a slot 214*b* (e.g., a "second slot"). It should be appreciated that, in some embodiments, enumerative adjectives (e.g., "first," "second," "third," or the like) may be used as a naming convention and are not intended to indicate an order or hierarchy (unless otherwise noted). For example, the terms a "first slot" and a "second slot" may distinguish two slots, but need not specify if the slots have a particular order or hierarchy. Furthermore, an element in a drawing is not limited to any particular enumerative adjective. For example, slot 214*a* may be referred to as a second slot if other slot(s) use appropriately distinguishing enumerative adjective(s).

In some embodiments, slot 214*a* may have a length and a width. Slot 214*b* may also have a length and a width. The length of slot 214*b* may be oriented approximately perpendicular to a length of slot 214*a*. The size of slots 214*a* and 214*b*, their spatial relationship with respect to other pairs of slots, their orientation, and the like, can be properties that relate to phasing. Phasing may determine the sensitivity of the antenna to a given property of transmit-beam 111 and receive-beam 113 (e.g., chirality).

In some embodiments, facesheet 210 (and/or backplane 104 (FIG. 1)) may have a circular shape. Pairs of through-hole slots 214 may be disposed as a spiral array about a center of facesheet 210. In some embodiments, pairs of through-hole slots 214 may be disposed as an array of concentric rings about a center of facesheet (concentric arrangement is not shown).

In some embodiments, dispositions of pairs of through-hole slots 214 are set by a computer process using spline interpolation of parameters of the antenna. The disposition of pairs of through-hole slots 214 to optimize or maximize a trade-off between transmit and receive gains associated with corresponding transmit-beam 111 and receive-beam 113. The computer process will be described below in reference to FIG. 5.

In some embodiments, the planes of the waveguide may be spaced using standoff spacers at a plurality of locations 215. Standoff spacers may be used instead of, or in addition to, foam spacer 108 (FIG. 1).

Figure 3B:
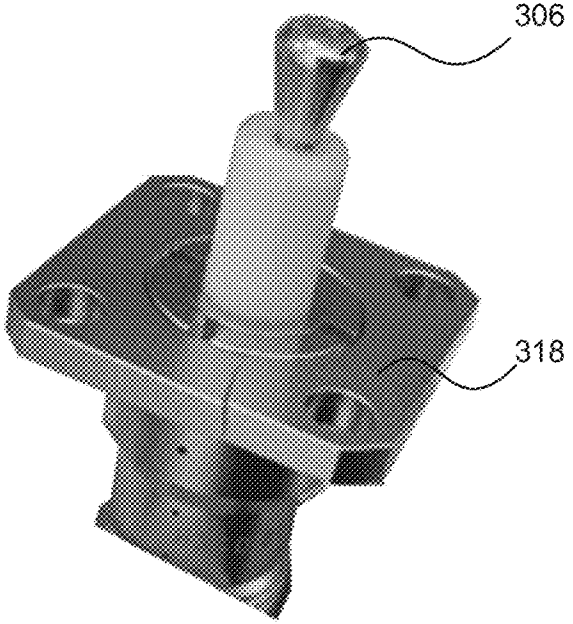
FIGS. 3A and 3B show a feed pin of an antenna, according to some embodiments.
Figure 3A:
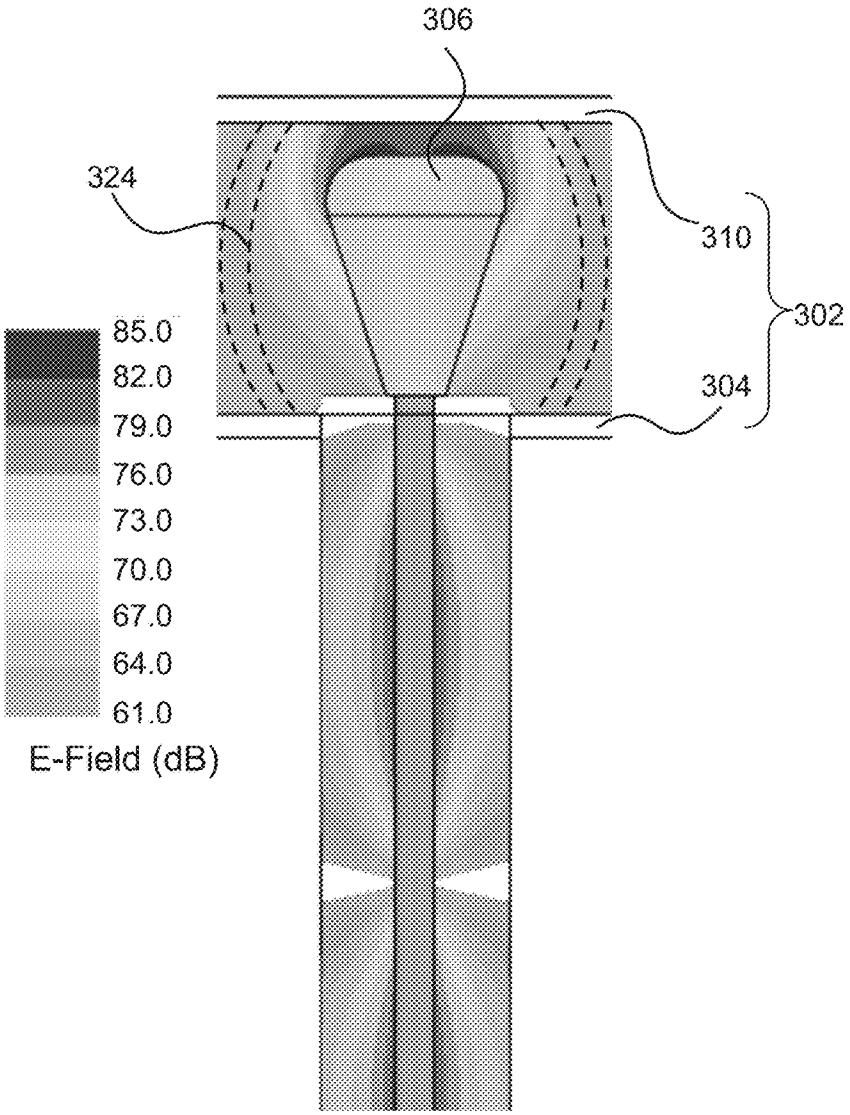

FIGS. 3A and 3B show a feed pin 306 of an antenna, according to some embodiments. In some embodiments, feed pin 306 may represent another view of feed pin 106 (FIG. 1) to show additional details. Feed pin 306 may be identical or similar feed pin 106 (FIG. 1). Unless otherwise noted, structures and functions described previously for elements of FIGS. 1 and 2 may also apply to similarly numbered elements of FIGS. 3A and 3B (e.g., reference numbers sharing the two right-most numeric digits) and the structures and functions of such elements should be apparent from descriptions of corresponding elements of FIGS. 1 and 2.

FIG. 3A shows a two-dimensional intensity plot of an electric field generated by feed pin 306, according to some embodiments. In some embodiments, the intensity of the electric field may be expressed in dB, with the more intense portions of the field being in the immediate vicinity of feed pin 306. Feed pin 306 may be disposed between backplane 304 and facesheet 310 of waveguide 302. Feed pin 306 may be disposed proximal to or at radial centers of backplane 304 and facesheet 310.

In some embodiments, when antenna 100 (FIG. 1) may be used to transmit a signal (transmit-mode), feed pin 306 may launch a wave 324 of radiation into waveguide 302. Wave 324 may propagate radially away from feed pin 306 and may be guided by waveguide 302. As wave 324 propagates out, wave 324 may encounter pairs of through-hole slots 214 (FIG. 2). The interaction between wave 324 and a pair of through-hole slots 214 may cause a portion of wave 324 to "leak" out from the pair of through-hole slots 214. As each of the plurality of through-hole slots 214 (FIG. 2) interacts with wave 324, a plurality of radiation leaks may occur at facesheet 310 in a given sequence. Each radiation leak has radiation properties that correspond to the dimensions and orientations of each of through-hole slots 214 (FIG. 2). The parameters of through-hole slots 214 (FIG. 2) are designed such that the leaked portions of wave 324 aggregate (e.g., constructively interfere) to form a highly directional transmit-beam 111 (FIG. 1).

In some embodiments, the operation of antenna 100 (FIG. 1) in receive mode uses a reversed counterpart process to couple receive-beam 113 to antenna 100 (FIG. 1). In the reverse process, radiation from receive-beam 113 is launched into waveguide 302 via the pairs of through-hole slots 214 (FIG. 2). The parameters of through-hole slots 214 (FIG. 2) are designed for optimized radiation-to-antenna coupling at a given frequency. The optimization may not necessarily correspond to maximum receive gain, but rather a trade-off optimization between transmit and receive gains. In some embodiments, increasing a receive gain may decrease a transmit gain, and vice versa. An antenna design method is disclosed herein that solves a trade-off optimization problem (e.g., by analyzing a Pareto front). Pareto efficiency or Pareto optimality is a situation where an individual criterion may not be better off without making at least another individual criterion worse off or without any loss thereof.

In some embodiments, it may difficult to arrive at a slot-design that would allow antenna 100 to meet a given industry standard. For example, requirements from telecommunications are presented in Table I. If a design for the slots of antenna 100 are poorly chosen, it may be difficult for a single antenna 100 to meet the requirements of both the receive band and the transmit band. However, the Pareto optimization disclosed herein may be used to maximize a combination of receive and transmit gains in accordance with an industry standard.

TABLE I

| Technical Parameter: | Receive Band: | Transmit Band: |
|---|---|---|
| Frequency of Operation | 7.168091821 GHz | 8.421790124 GHz |
| Polarization | LHCP | LHCP |
| Return Loss | >12.5 dB, minimum | >12.5 dB, minimum |
| Gain (Boresight ±1 degree) | 20.0 dBic | 29.0 dBic |
| RF Power Handling | <1 watt | 65 Watts, typical |

Figure 4:
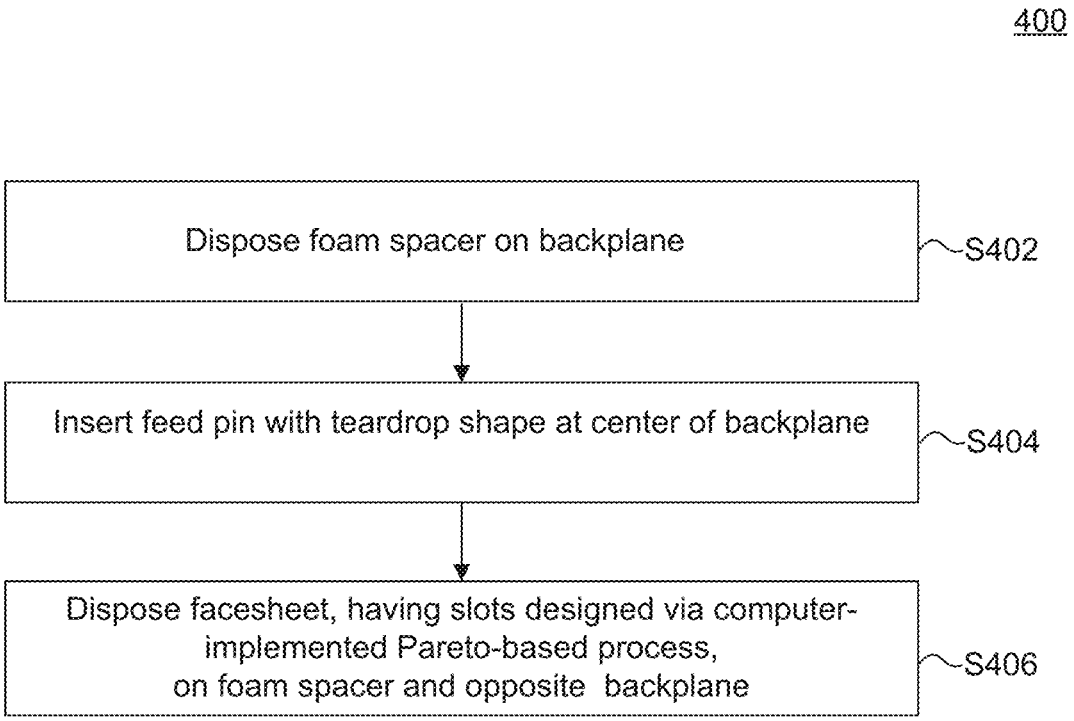
FIGS. 4 and 5 show methods for designing and constructing an antenna, according to some embodiments.

FIG. 4 shows a method 400 for designing and constructing an antenna, according to some embodiments. Without limitation and for example purposes only, structures of FIGS. 1-3 may be referenced to give better context to method 400. In some embodiments, at step S402, foam spacer 108 may be disposed on backplane 104. At step S404, feed pin 106 including a teardrop shape may be inserted at a center of the backplane. At step S406, facesheet 110 may be disposed on foam spacer 108 and opposite backplane 104. Facesheet 110 may include slots 214 designed via a computer-implemented Pareto-based process.

Figure 5:
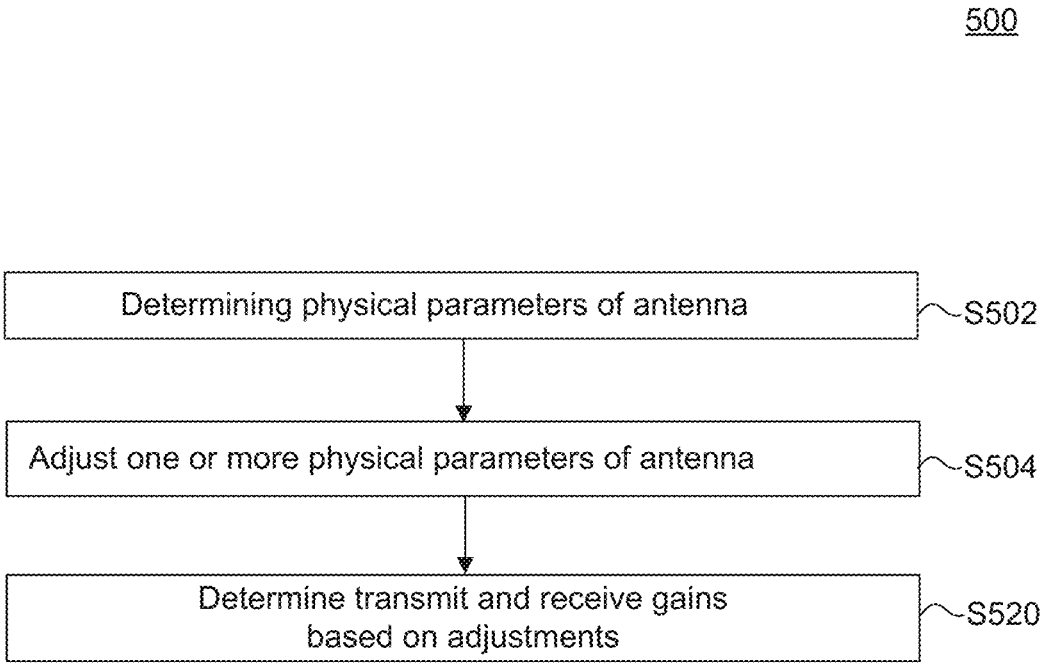

FIG. 5 shows a method 500 for designing an antenna, according to some embodiments. Without limitation and for example purposes only, structures of FIGS. 1-3 may be referenced to give better context to method 500. In some embodiments, method 500 may be directed to the computer-implemented process mentioned in step S406 (FIG. 4).

In some embodiments, method 500 may be used for determining a Pareto front of transmit and receive gains of antenna 100 using an evolutionary multi-objective process at step S502. The Pareto front may be based on, for example, at least the pairs of through-hole slots 214 being used for transmitting transmit-beam 111 and for receiving receive-beam 113, the pairs of through-hole slots 214 being disposed as a spiral array about a center of facesheet 110, each of the pairs of through-hole slots 214 including a slot 214*a* having a length and a width and a slot 214*b* having a length and a width, and the length of slot 214*b* being oriented approximately perpendicular to the length of the slot 214*a*.

In some embodiments, step S502 may include determining physical parameters of antenna 100.

In some embodiments, step S504 may include adjusting one or more of the physical parameters of antenna 100.

In some embodiments, step S520 may include determining the transmit and/or receive gains based on the adjusting. The transmit and receive gains may correspond to a plurality of antenna design variations.

Figure 6:
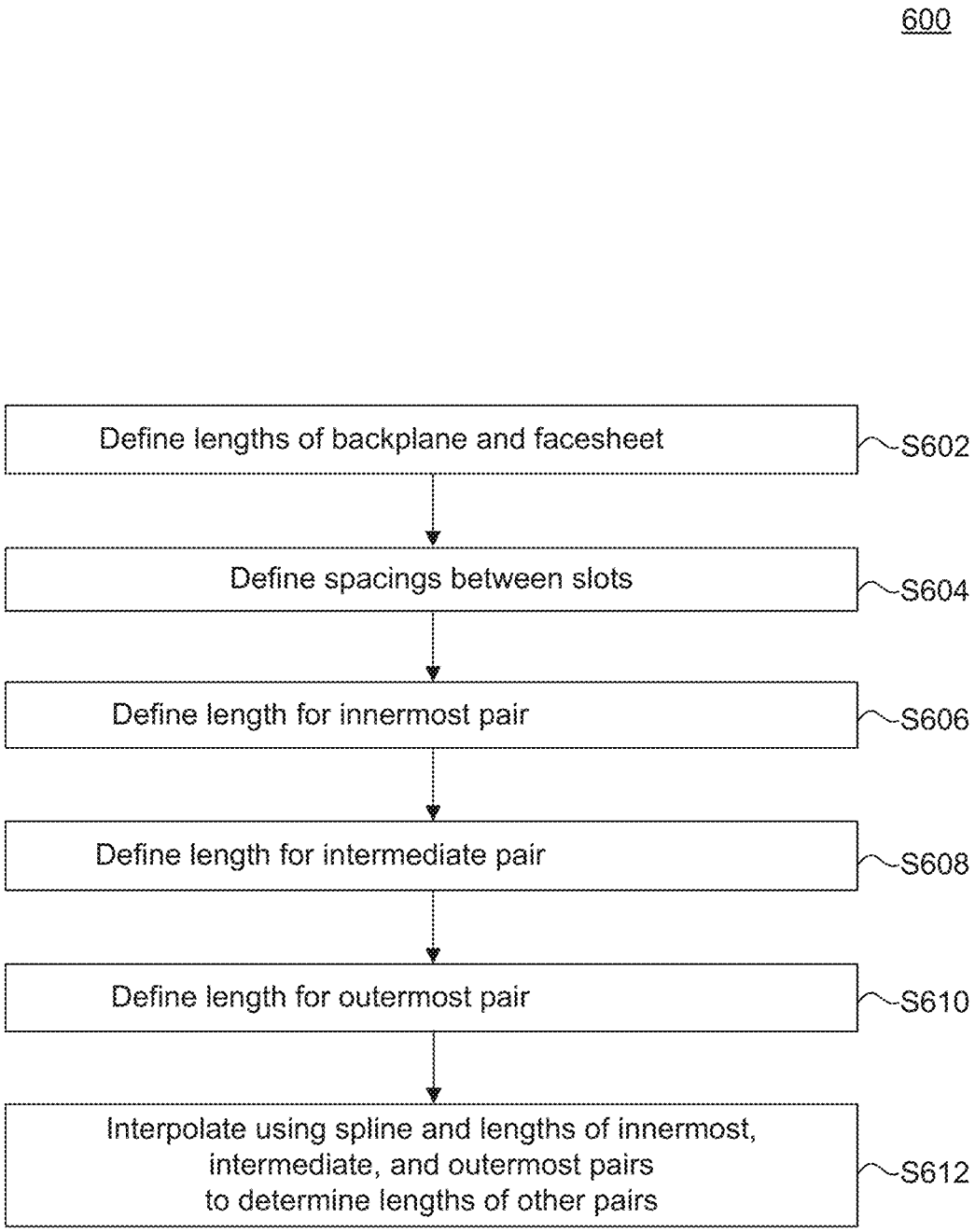
FIG. 6 shows a method for determining physical parameters of an antenna, according to some embodiments

FIG. 6 shows a method 600 for determining physical parameters of antenna 100, according to some embodiments. In some embodiments, method 600 may correspond to step S502 (FIG. 5).

In some embodiments, step S602 may include defining lengths of backplane 104 and facesheet 110.

In some embodiments, step S604 may include defining spacings between slots 214 (e.g., spacing between slots 214*a* and 214*b*, spacing between pairs of through-hole slots 214, spacing between rings of the spiral, or the like).

In some embodiments, step S606 may include defining a length for an innermost one of pairs of through-hole slots 214.

In some embodiments, step S608 may include defining a length for an intermediate one of pairs of through-hole slots 214.

In some embodiments, step S610 may include defining a length for an outermost one of the pairs of through-hole slots 214.

In some embodiments, step S612 may include interpolating using a spline and the lengths of the inner most, intermediate, and outermost ones of the pairs of through-hole slots 214 to determine lengths of other ones of the pairs of through-hole slots 214.

Figure 7:
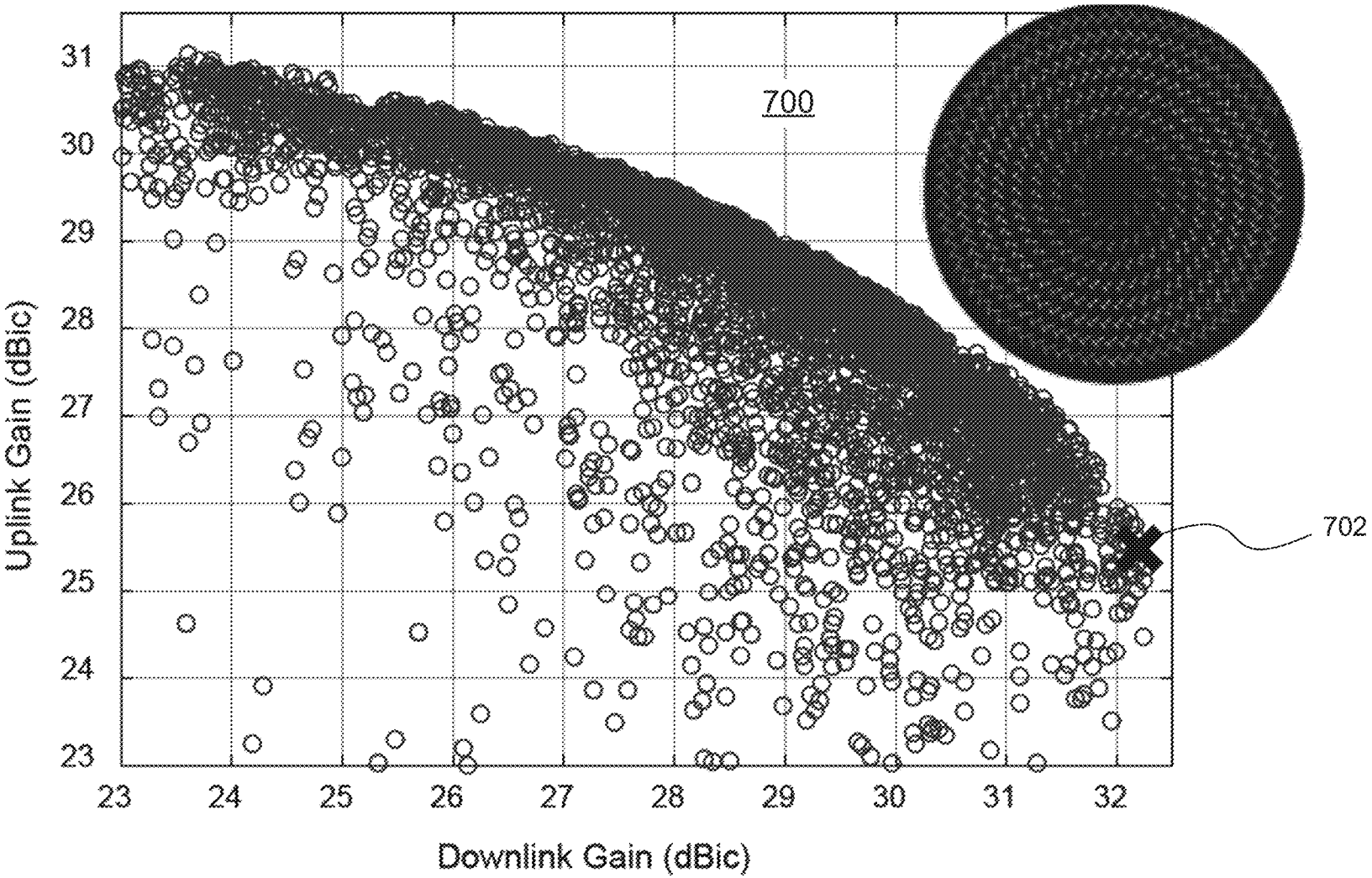
FIG. 7 shows a graph plot of a Pareto front for an antenna, according to some embodiments.

FIG. 7 shows a graph 700 of a Pareto front, according to some embodiments. In some embodiments, the vertical axis represents a gain for uplink while the horizontal axis represents a gain for downlink. Units are provided in dBic as a non-limiting example only. In some embodiments, each data point in the Pareto front may represent one variation of antenna 100 according to the adjustments made at step S504 and the corresponding gains determined at step S506 (FIG. 5). In some embodiments, the slot arrangement corresponding to data point 702 may be selected for implementation on antenna 100. Data point 702 may closely align to an industry standard (e.g., a communications standard) while maximizing trade-off between transmit and receive gains of antenna 100.

Referring again to FIG. 5, in some embodiments, the adjusting of the physical parameters at step S504 may be used to produce a population of approximately 50 or more different designs for antenna 100 along with corresponding transmit/receive gain trade-offs. The evolutionary multi-objective process for the adjusting at step S504 may include a R2 indicator-based linear regression process, e.g., a R2 indicator-based evolutionary multi-objective algorithm (R2-EMOA). The adjusting at step S504 may include adjusting a start position of the innermost one of the pairs of through-hole slots 214 and spacing between the outermost one of the pairs of through-hole slots 214 and an edge of backplane 104. The evolutionary multi-objective process may include iterating an integral equation solver to determine characteristics of the transmit-beam 111 and receive-beam 113 (e.g., gains).

In some embodiments, the adjusting of the physical parameters at step S518 may include minimizing so-called fitness functions. A non-limiting example of a fitness function is a function corresponding to an efficiency of transmit-beam 111. Another non-limiting example of a fitness function is a function corresponding to an efficiency of receive-beam 113. In a more specific non-limiting example, a first fitness function may be defined as one hundred minus the percent efficiency at 8.4 GHz for a first fitness function and the second fitness function may be defined as one hundred minus the percent aperture efficiency at 7.2 GHz. Another way of viewing this the fitness functions is that one function maximizes gain at 8.4 GHz and the other at 7.2 GHz.

In some embodiments, the determining of the physical parameters of antenna 100 at step S502 may include defining an effective refractive index associated with a foam spacer 108. For example, foam spacer 108 may be constructed of dielectric material that causes waveguide 102 to behave as having an effective refractive index close to 1 (e.g., approximately 1.0 to 1.5). The selection of this material is made possible by the Pareto optimization method. Without Pareto optimization, slotted waveguide antennas may be limited to using slow wave material for foam spacer 108 (e.g., a refractive index of 2.0 or higher).

Method steps disclosed herein may be performed in any conceivable order and it is not required that all steps be performed. Moreover, the method steps of FIGS. 4-6 described above merely reflect an example of steps and are not limiting. That is, further method steps are envisaged based upon functions described in reference to FIGS. 1-3, 7, and 8.

Figure 8:
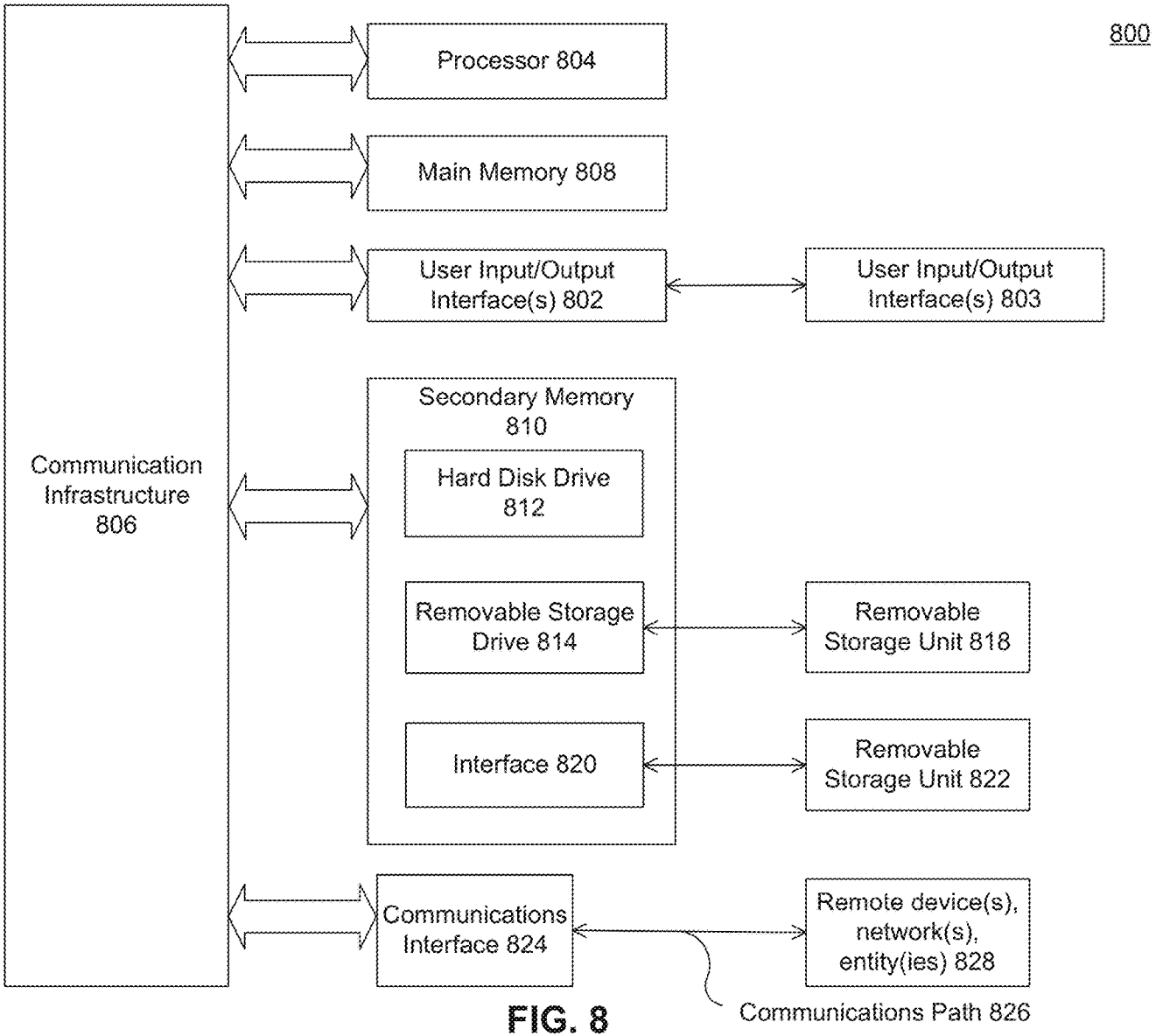
FIG. 8 shows a computer system, according to some embodiments.

FIG. 8 shows a computer system 800, according to some embodiments. Various embodiments and components therein may be implemented, for example, using computer system 800 or any other well-known computer systems. For example, the method steps of FIGS. 4-6 may be implemented via computer system 800.

In some embodiments, computer system 800 may include one or more processors (also called central processing units, or CPUs), such as a processor 804. Processor 804 may be connected to a communication infrastructure or bus 806.

In some embodiments, one or more processors 804 may each be a graphics processing unit (GPU). In an embodiment, a GPU is a processor that is a specialized electronic circuit designed to process mathematically intensive applications. The GPU may have a parallel structure that is efficient for parallel processing of large blocks of data, such as mathematically intensive data common to computer graphics applications, images, videos, etc.

In some embodiments, computer system 800 may further include user input/output device(s) 803, such as monitors, keyboards, pointing devices, etc., that communicate with communication infrastructure or bus 806 through user input/output interface(s) 802. Computer system 800 may further include a main or primary memory 808, such as random access memory (RAM). Main memory 808 may include one or more levels of cache. Main memory 808 has stored therein control logic (i.e., computer software) and/or data.

In some embodiments, computer system 800 may further include one or more secondary storage devices or memory 810. Secondary memory 810 may include, for example, a hard disk drive 812 and/or a removable storage device or drive 814. Removable storage drive 814 may be a floppy disk drive, a magnetic tape drive, a compact disk drive, an optical storage device, tape backup device, and/or any other storage device/drive. Removable storage drive 814 may interact with a removable storage unit 818. Removable storage unit 818 may include a computer usable or readable storage device having stored thereon computer software (control logic) and/or data. Removable storage unit 818 may be a floppy disk, magnetic tape, compact disk, DVD, optical storage disk, and/any other computer data storage device. Removable storage drive 814 reads from and/or writes to removable storage unit 818 in a well-known manner.

In some embodiments, secondary memory 810 may include other means, instrumentalities or other approaches for allowing computer programs and/or other instructions and/or data to be accessed by computer system 800. Such means, instrumentalities or other approaches may include, for example, a removable storage unit 822 and an interface 820. Examples of the removable storage unit 822 and the interface 820 may include a program cartridge and cartridge interface (such as that found in video game devices), a removable memory chip (such as an EPROM or PROM) and associated socket, a memory stick and USB port, a memory card and associated memory card slot, and/or any other removable storage unit and associated interface.

In some embodiments, computer system 800 may further include a communication or network interface 824. Communication interface 824 enables computer system 800 to communicate and interact with any combination of remote devices, remote networks, remote entities, etc. (individually and collectively referenced by reference number 828). For example, communication interface 824 may allow computer system 800 to communicate with remote devices 828 over communications path 826, which may be wired and/or wireless, and which may include any combination of LANs, WANs, the Internet, etc. Control logic and/or data may be transmitted to and from computer system 800 via communications path 826.

In some embodiments, a non-transitory, tangible apparatus or article of manufacture including a non-transitory, tangible computer useable or readable medium having control logic (software) stored thereon is also referred to herein as a computer program product or program storage device. This includes, but is not limited to, computer system 800, main memory 808, secondary memory 810, and removable storage units 818 and 822, as well as tangible articles of manufacture embodying any combination of the foregoing. Such control logic, when executed by one or more data processing devices (such as computer system 800), causes such data processing devices to operate as described herein.

Based on the teachings contained in this disclosure, it will be apparent to those skilled in the relevant art(s) how to make and use embodiments of this disclosure using data processing devices, computer systems and/or computer architectures other than that shown in FIG. 8. In particular, embodiments may operate with software, hardware, and/or operating system implementations other than those described herein.

Although specific reference may have been made above to the use of embodiments of the present disclosure in the context of antennas for use in space, it will be appreciated that the present disclosure may be used in other applications, for example land-based antennas.

It is to be understood that the phraseology or terminology herein is for the purpose of description and not of limitation, such that the terminology or phraseology of the present disclosure is to be interpreted by those skilled in relevant art(s) in light of the teachings herein.

It is to be appreciated that the Detailed Description section, and not the Summary and Abstract sections, is intended to be used to interpret the claims. The Summary and Abstract sections may set forth one or more but not all exemplary embodiments of the present disclosure as contemplated by the inventor(s), and thus, are not intended to limit the present disclosure and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries may be defined so long as the specified functions and relationships thereof are appropriately performed.

While specific embodiments of the disclosure have been described above, it will be appreciated that embodiments of the present disclosure may be practiced otherwise than as described. The descriptions are intended to be illustrative, not limiting. Thus it will be apparent to one skilled in the art that modifications may be made to the disclosure as described without departing from the scope of the claims set out below.

The foregoing description of the specific embodiments will so fully reveal the general nature of the present disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein.

The breadth and scope of the protected subject matter should not be limited by any of the above-described exemplary embodiments, but should be defined only in accordance with the following claims and their equivalents.

What is claimed is:

1. An antenna comprising:

a waveguide configured to transmit a transmit-beam of radiation and receive a receive-beam of radiation, the waveguide comprising:

a backplane comprising radial support ribs;

a feed pin comprising a teardrop shape and disposed at a center of the backplane and configured to interact with a wave of radiation;

a foam spacer disposed on the backplane, wherein an effective refractive index of the waveguide with the foam spacer is greater than approximately 1.0 and less than approximately 1.5;

a facesheet disposed on the foam spacer and opposite to the backplane 104 to allow the wave of radiation to propagate between the backplane and the facesheet and through the foam spacer, the facesheet comprising:

thermal paint disposed on an outward-facing side of the facesheet; and pairs of through-hole slots configured to release portions of the wave of radiation to generate the transmit-beam or to receive the receive-beam to generate the wave of radiation, wherein the pairs are disposed as a spiral array about a center of the facesheet and each of the pairs comprises:

a first slot having a length and a width; and a second slot having a length and a width, wherein the length of the second slot is oriented approximately perpendicular to a length of the first slot, wherein dispositions of the pairs of through-hole slots are set by a computer process using spline interpolation of parameters of the antenna and are configured to optimize or maximize trade-off between transmit and receive gains associated with the transmit-beam and receive-beam.

2. The antenna of claim 1, wherein the backplane and facesheet each have a circular shape.

3. The antenna of claim 1, wherein the feed pin is disposed between the backplane and the facesheet and is proximal to the center of the facesheet.

4. The antenna of claim 1, wherein the transmit-beam and the receive-beam have different frequencies from each other that define a wide bandwidth greater than approximately 0.1 GHz and less than approximately 100 GHz.

5. The antenna of claim 1, wherein the transmit-beam and the receive-beam have different frequencies from each other that define a wide bandwidth greater than approximately 7.2 GHz and less than approximately 8.4 GHz.

6. The antenna of claim 1, wherein the pairs of through-hole slots are disposed to maximize a combination of the transmit and receive gains in accordance with an industry standard.

7. The antenna of claim 1, wherein the backplane comprises aluminum, and the facesheet comprises aluminum.

8. The antenna of claim 1, wherein the feed pin comprises gold plated beryllium copper.

9. The antenna of claim 1, wherein the foam spacer comprises a dielectric material, and the effective refractive index is greater than approximately 1.0 and less than approximately 1.5.

10. The antenna of claim 1, further comprising:

a connector coupled to the feed pin; and a shim disposed between the connector and the backplane, the shim comprising a hole to allow the feed pin to be inserted through the backplane.

* * * * *